US011535986B2

(12) United States Patent
Benesch et al.

(10) Patent No.: US 11,535,986 B2
(45) Date of Patent: Dec. 27, 2022

(54) SPREADER

(71) Applicant: Douglas Dynamics, LLC, Milwaukee, WI (US)

(72) Inventors: Ryan Benesch, Masonville, IA (US); Jeffrey Krogmann, Manchester, IA (US)

(73) Assignee: Douglas Dynamics, LLC, Milwaukee, WI (US)

( * ) Notice: Subject to any disclaimer, the term of this patent is extended or adjusted under 35 U.S.C. 154(b) by 62 days.

(21) Appl. No.: 16/117,123

(22) Filed: Aug. 30, 2018

(65) Prior Publication Data

US 2019/0063008 A1 Feb. 28, 2019

Related U.S. Application Data

(60) Provisional application No. 62/552,138, filed on Aug. 30, 2017.

(51) Int. Cl.

| | |
|---|---|
| ***E01C 19/20*** | (2006.01) |
| ***E01C 19/21*** | (2006.01) |
| ***E01H 10/00*** | (2006.01) |

(52) U.S. Cl.

CPC ..... *E01C 19/2025* (2013.01); *E01C 19/203* (2013.01); *E01C 19/21* (2013.01); *E01H 10/007* (2013.01); *E01C 2019/208* (2013.01); *E01C 2019/209* (2013.01); *E01C 2019/2095* (2013.01)

(58) Field of Classification Search

CPC ..... E01C 19/2025; E01C 19/21; E01C 2019/208; E01C 2019/207; E01C 19/20; E01C 2019/2095; E01H 10/007; A01C 19/203; A01C 2019/209; A01C 2019/2095; A01C 3/066; A01C 17/003; B65G 65/46; B01F 27/70; B01F 27/701; B01F 23/50

USPC ..... 239/668–680

See application file for complete search history.

(56) References Cited

U.S. PATENT DOCUMENTS

| | | | | |
|---|---|---|---|---|
| 3,236,527 | A * | 2/1966 | Suyder | A01M 9/0069 239/656 |
| 4,071,226 | A | 1/1978 | Miller | |
| 4,504,253 | A | 3/1985 | Buschbom et al. | |
| 4,551,024 | A | 11/1985 | Clapp | |
| 4,741,625 | A | 5/1988 | Neier | |
| 5,002,426 | A | 3/1991 | Brown et al. | |
| 5,199,638 | A * | 4/1993 | Fischer | A01C 3/063 239/675 |
| 5,570,953 | A * | 11/1996 | DeWall | B28C 5/0831 366/10 |
| 5,609,416 | A | 3/1997 | Duckworth | |
| 5,866,201 | A | 2/1999 | Blue | |

(Continued)

*Primary Examiner* — Tuongminh N Pham
*Assistant Examiner* — Juan C Barrera
(74) *Attorney, Agent, or Firm* — Wood Herron & Evans LLP

(57) ABSTRACT

A vehicle mounted spreader for spreading materials such as sand, salt, or other granular chemicals onto snow and ice covered paved surfaces comprises a material container for containing the material to be spread, a liquid container for containing liquid with which to pre-wet the material, a spinner for spreading the pre-wet material, an auger for conveying the material to the spinner, a liquid applicator for applying liquid to the material to pre-wet the material, and a paddle mixer mounted to an end of the auger adjacent the liquid applicator for mixing the liquid and the material.

17 Claims, 15 Drawing Sheets

(56) References Cited

U.S. PATENT DOCUMENTS

| | | | | |
|---|---|---|---|---|
| 6,517,232 | B1 | 2/2003 | Blue | |
| 6,536,939 | B1 | 3/2003 | Blue | |
| 7,100,760 | B2 * | 9/2006 | Hoerle | B01F 7/00416 198/625 |
| 7,513,963 | B2 | 4/2009 | Frank et al. | |
| 7,524,386 | B2 | 4/2009 | George et al. | |
| 7,566,166 | B2 | 7/2009 | Neier et al. | |
| 8,104,648 | B2 | 1/2012 | Restive et al. | |
| 8,152,358 | B2 | 4/2012 | Conard et al. | |
| 8,177,419 | B2 | 5/2012 | Neier et al. | |
| 9,194,092 | B2 | 11/2015 | Kline | |
| 9,376,604 | B2 | 6/2016 | Hoerle et al. | |
| 9,475,018 | B1 | 10/2016 | Paz | |
| 9,587,358 | B2 | 3/2017 | Roy | |
| 2008/0035217 | A1 | 2/2008 | Hartman et al. | |
| 2009/0032624 | A1 * | 2/2009 | Truan | E01H 10/007 239/675 |
| 2011/0044126 | A1 | 2/2011 | Hull | |
| 2012/0048958 | A1 * | 3/2012 | Stevenson | A01C 3/066 239/1 |
| 2014/0231553 | A1 * | 8/2014 | Truan | E01C 19/203 239/661 |
| 2017/0080601 | A1 | 3/2017 | Hernandez et al. | |

* cited by examiner

SPREADER

RELATED APPLICATIONS

This application claims the priority benefit of U.S. Provisional Patent Application No. 62/552,138 filed Aug. 30, 2017, which is hereby incorporated by reference herein as if fully set forth in its entirety.

FIELD OF THE INVENTION

This invention relates generally to snow and ice control, and more particularly to improvements in spreaders for spreading sand, salt, or other granular chemicals onto snow and ice covered paved surfaces.

BACKGROUND OF THE INVENTION

Spreaders for spreading salt or other granular chemicals for melting snow and ice on paved surfaces, or for spreading abrasives such as sand for otherwise reducing the deleterious effects of snow and ice on paved surfaces, are well known. One type of spreader has a container for containing the material to be spread, a spinner for spreading the material onto the pavement, and an auger for moving the material from the container to the spinner.

Pre-wetting is a technique utilized in some spreaders. In pre-wetting, a liquid, for example water, salt brine, beet juice, magnesium chloride, or calcium chloride, is applied to the material just before it is spread by the spinner. Pre-wetting salt is advantageous in that it starts a chemical reaction that accelerates melting of the snow and ice thus achieving faster results. Another advantage of pre-wetting is that pre-wet particles or granules bounce less, resulting in more of the material staying on the pavement. Some studies show that pre-wetting can reduce salt application rates by 20-30%.

One known technique for pre-wetting the material to be spread is to inject or otherwise spray liquid onto the material near the end of its travel along the auger just prior to the material being spread by the spinner. A criticism of this technique is that the liquid and material does not mix completely.

Accordingly, it is desirable to completely or at least more thoroughly mix the liquid and material spread by the spreader.

SUMMARY OF THE INVENTION

In one aspect, a vehicle mounted spreader for spreading materials such as sand, salt, or other granular chemicals onto snow and ice covered paved surfaces is provided. The spreader comprises a material container for containing the material to be spread, a liquid container for containing liquid with which to pre-wet the material, a spinner for spreading the pre-wet material, an auger for conveying the material to the spinner, a liquid applicator for applying liquid to the material to pre-wet the material, and a paddle mixer mounted to an end of the auger adjacent the liquid applicator for mixing the liquid and the material.

The material container can be a V-hopper. In that case the auger is oriented generally parallel to a longitudinal axis of the vehicle, and the spinner is located generally on the longitudinal axis of the vehicle. The spreader can include two such augers.

The material container can also be a dump body of a dump truck. In that case, the auger is oriented generally perpendicular to a longitudinal axis of the vehicle, and the spinner is located off of the longitudinal axis of the vehicle. The dump body can have a tailgate; the auger is positioned adjacent a lower edge of the tailgate. Alternatively, the auger can be fabricated as a portion of a replacement tailgate for replacing an OEM tailgate of the dump body.

The paddle mixer can comprise a plurality of longitudinally extending blades attached to the auger, spaced circumferentially around the auger, and extending away from the auger. The blades can extend away from the auger at an angle of between about 0 degrees and about 90 degrees relative to a cross-sectional centerline of the auger. Preferably the blades extend away from the auger at an angle of about 23 degrees relative to a cross-sectional centerline of the auger. The paddle mixer can further comprise first and second circular rings spaced along and secured to the auger, with the blades having first ends secured to the first ring and second ends secured to the second ring. Each blade can include a plurality of notches spaced along a radially outer edge of the blade. The notches can be oriented at an angle of between about 0 degrees and about 90 degrees relative to an axis of rotation of the auger. Preferably the notches are oriented at an angle of about 45 degrees relative to the axis of rotation of the auger. The paddle mixer can comprise four blades spaced equally about a circumference of the auger, a first pair of blades being positioned diametrically opposite to one another and having radially inner edges closely adjacent to an outer surface of the auger, a second pair of blades being positioned diametrically opposite to one another and having radially inner edges spaced away from the outer surface of the auger. The blades and notches can be configured such that the notches in the first pair of blades face one end of the auger and the notches in the second pair of blades face the other end of the auger. The blades can be straight or helical. One suitable helical geometry is for the blades to make about a quarter turn in about twelve inches.

In another aspect, a paddle mixer adapted to be used in a vehicle mounted spreader for spreading materials such as sand, salt, or other granular chemicals onto snow and ice covered paved surfaces is provided.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
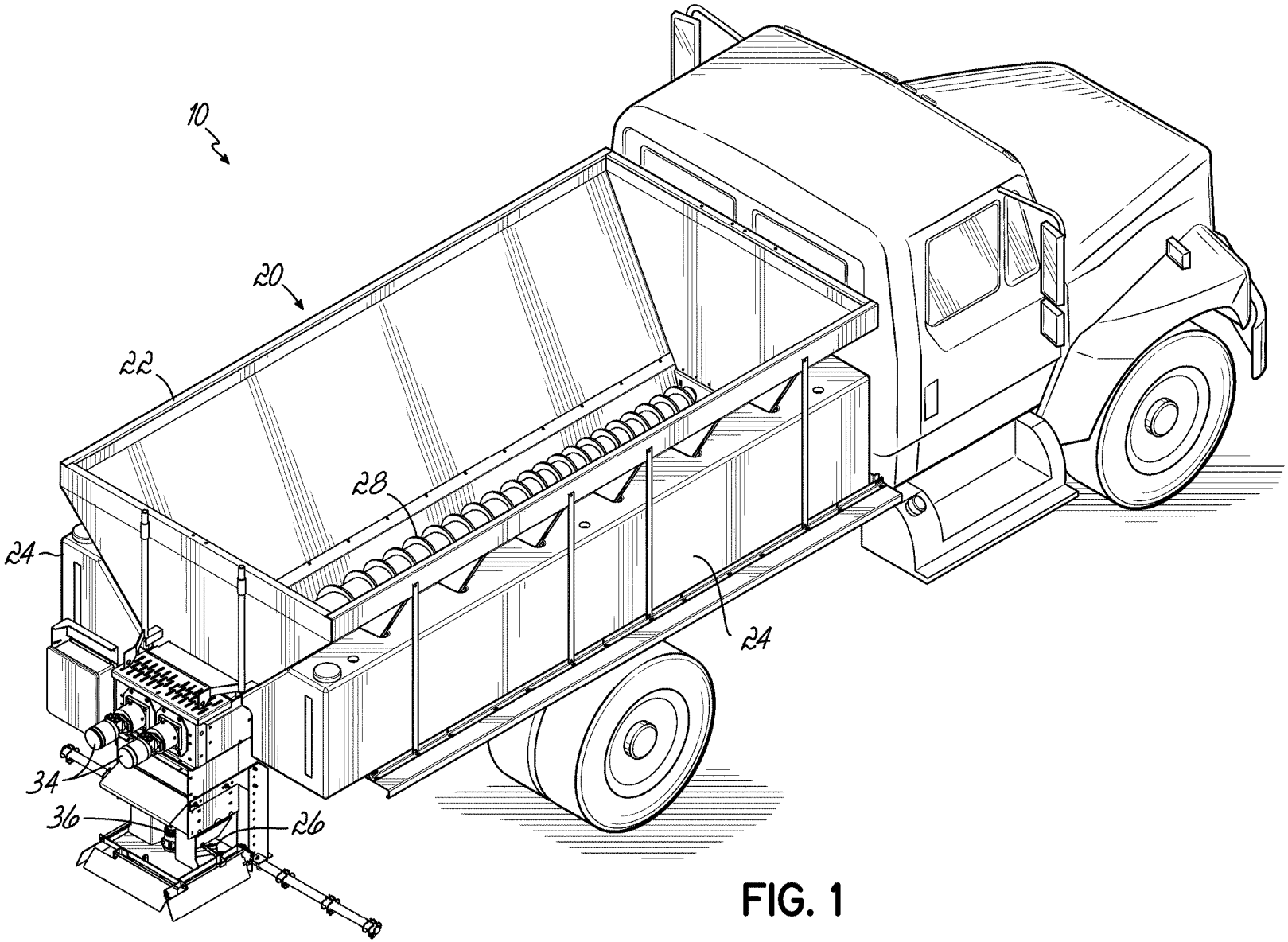
FIG. 1 is a top right rear perspective view of a vehicle and one embodiment of spreader of the present invention.
Figure 2:
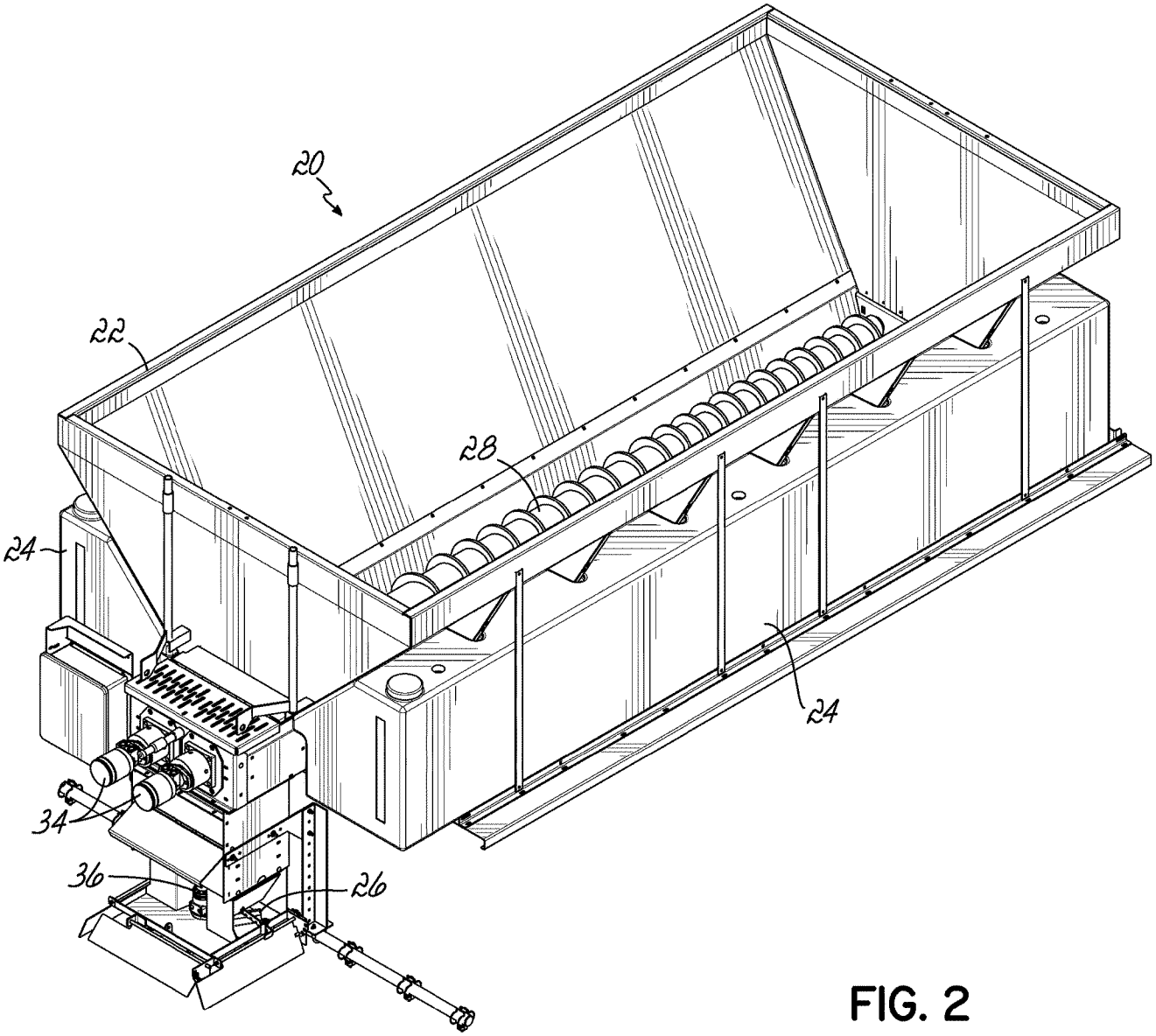
FIG. 2 is an enlarged top right rear perspective view of the spreader of FIG. 1.
Figure 3:
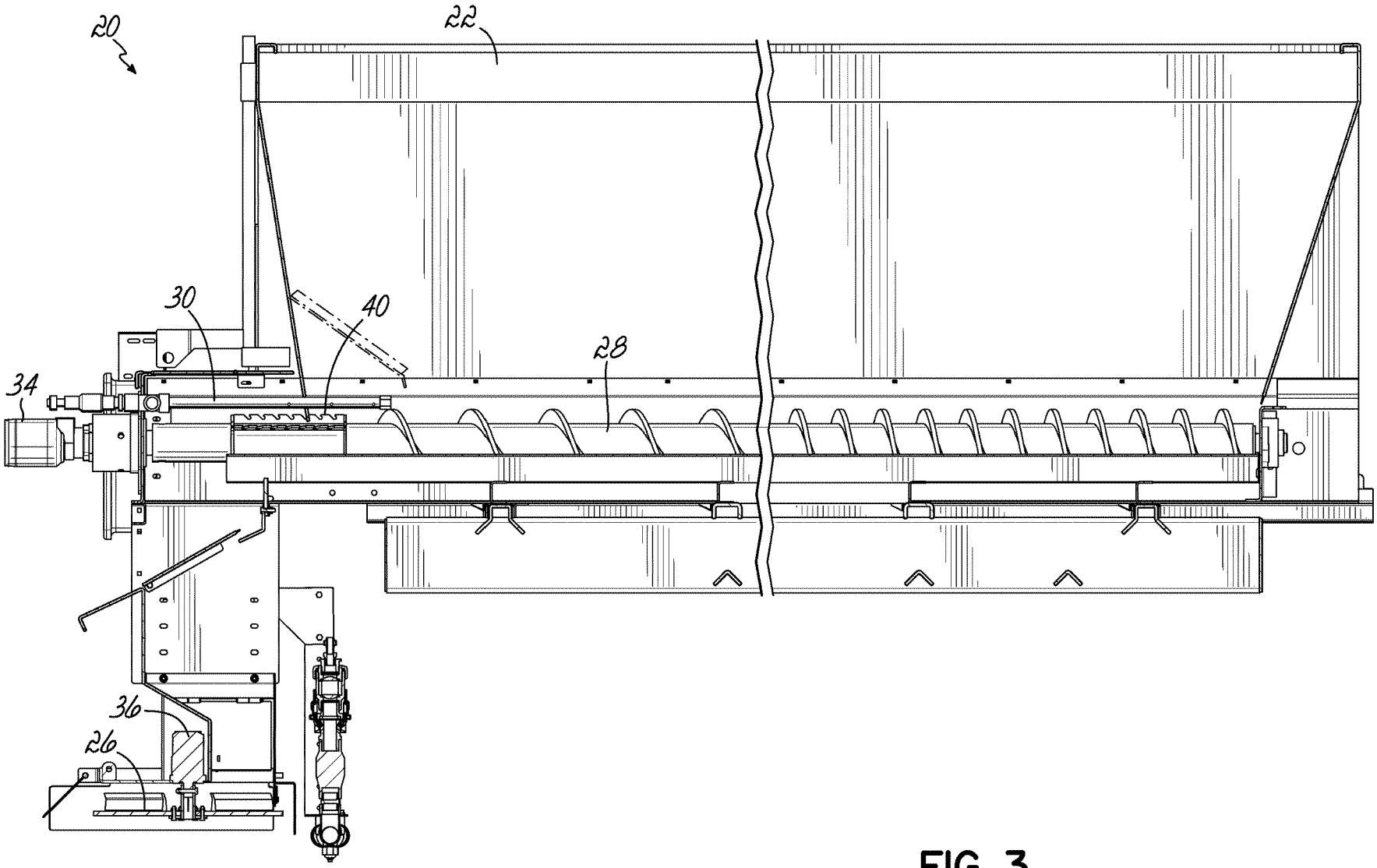
FIG. 3 is a side cross-sectional view of the spreader taken along line 3-3 in FIG. 4.
Figure 4:
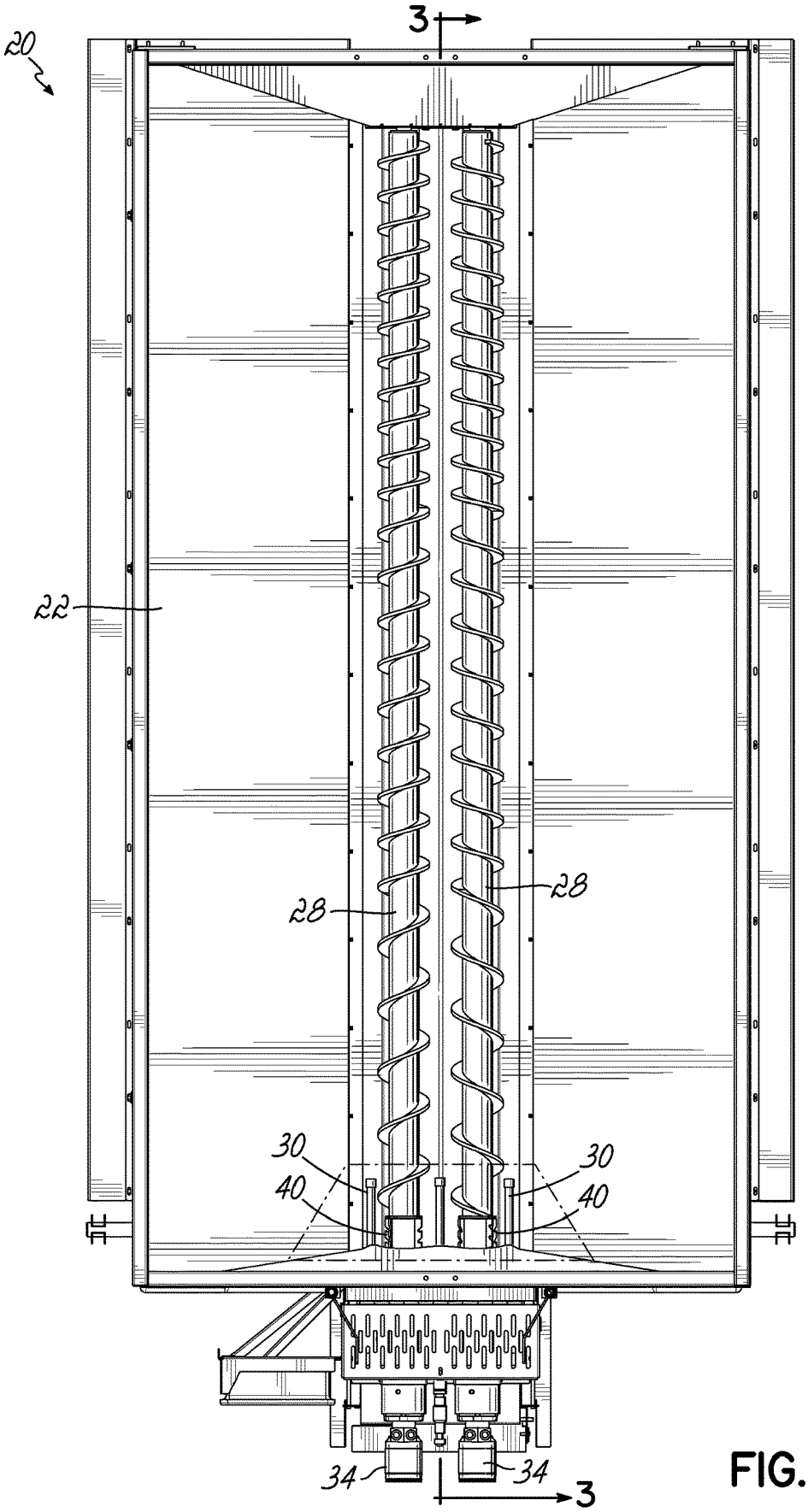
FIG. 4 is a top view of the spreader of FIG. 1.
Figure 5:
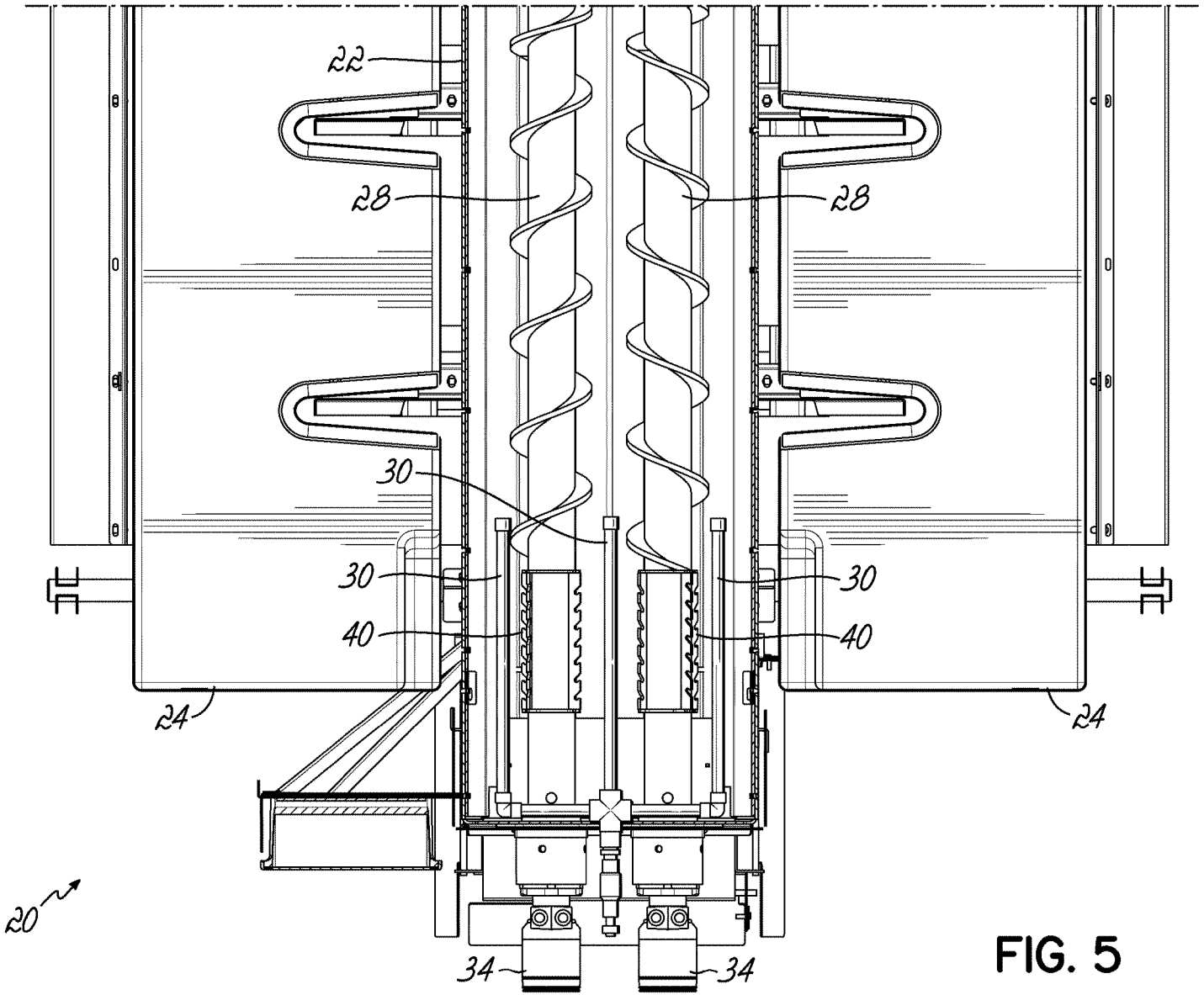
FIG. 5 is an enlarged top view of the aft end of the spreader of FIG. 1.
Figure 6:
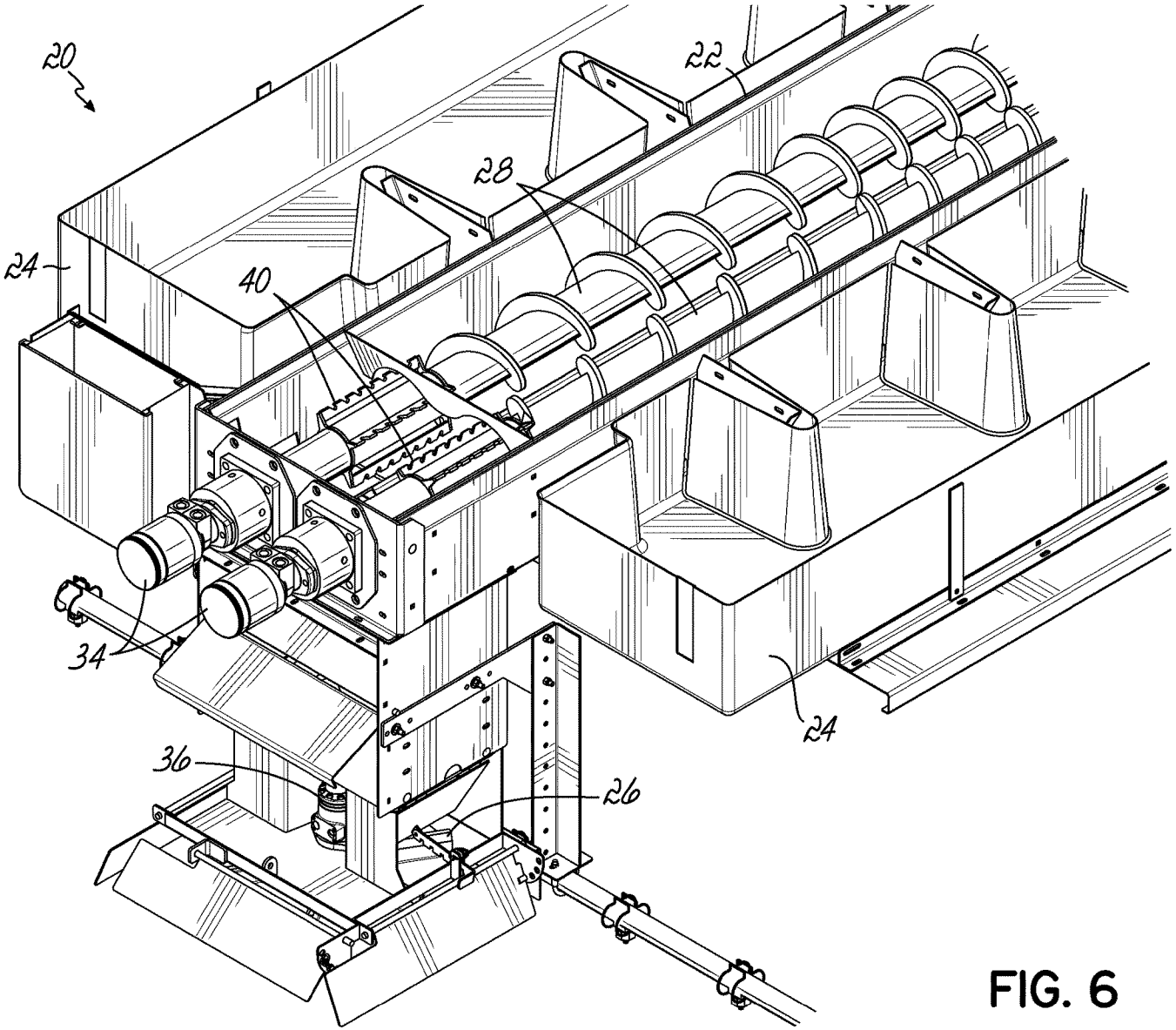
FIG. 6 is an enlarged top right rear perspective view of the spreader of FIG. 1.
Figure 7:
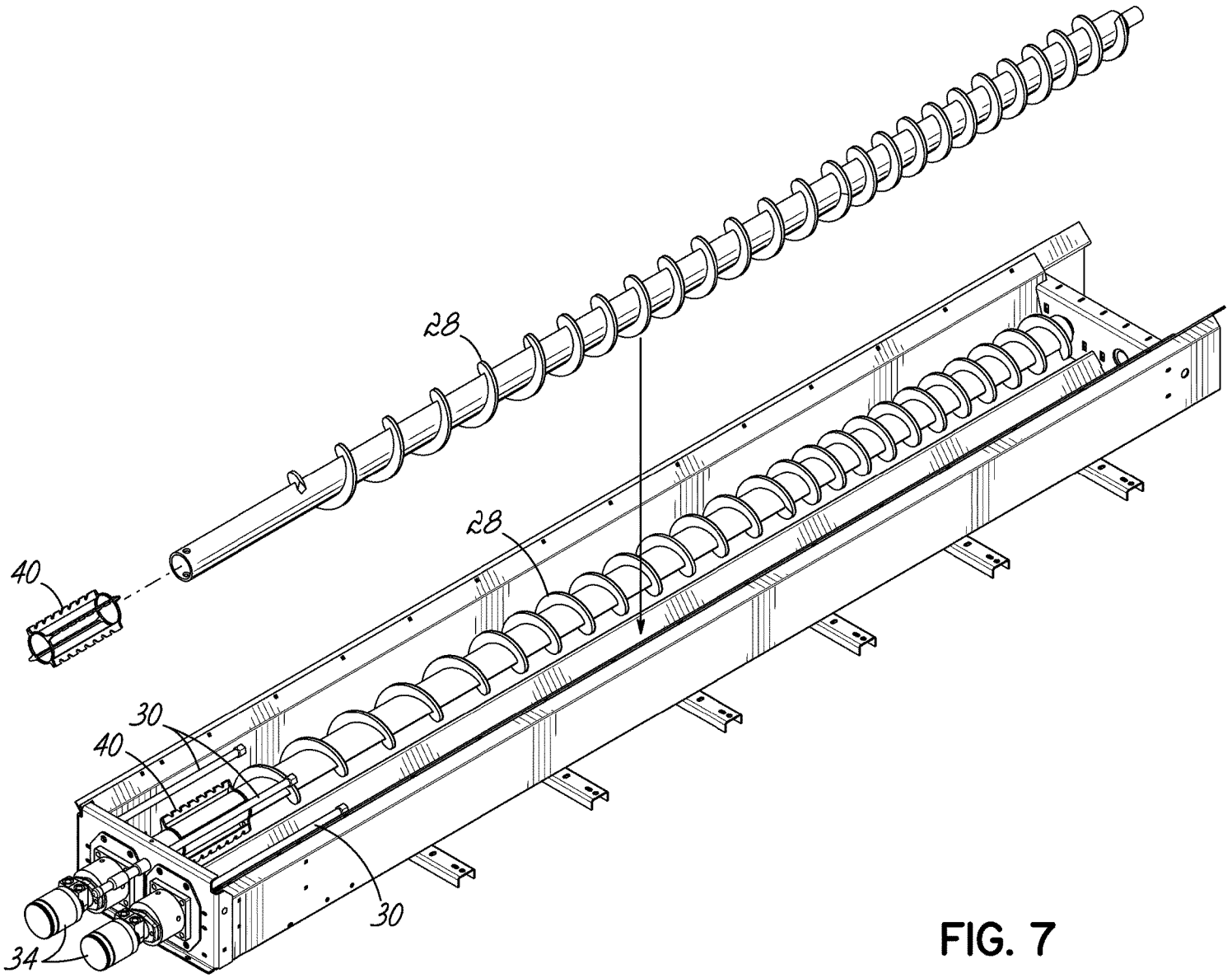
FIG. 7 is a partially exploded top right rear perspective view of the dual augers of the spreader of FIG. 1.

Referring first to FIG. 1, a vehicle 10 has mounted on it a spreader 20 (sometimes referred to as a hopper spreader) according to the principles of the present invention. Referring to FIGS. 1-7, the spreader 20 has a material container in the form of a V-hopper 22 for containing the material to be spread, a liquid container 24 for containing liquid with which to pre-wet the material, a spinner 26 for spreading the pre-wet material, one or more augers 28 for conveying the material to the spinner 26, and one or more liquid applicators 30 for applying liquid to the material to pre-wet the material. In this embodiment the augers 28 are oriented generally parallel to a longitudinal axis of the vehicle 10 and the spinner 26 is located generally on the longitudinal axis of the vehicle 10. While two counter-rotating augers 28 are shown in the embodiment of spreader 20, it will be appreciated that the present invention can be practiced with only a single auger 28. Each auger is powered by a motor and gear box 34. The spinner 26 is powered by a motor and gear box 36. A paddle mixer 40 is mounted to an end of each auger 28. The paddle mixers 40 mix the liquid with the material as the liquid is applied to the material with the liquid applicators 30. Suitable motors drive the spinner 26 and augers 28 as known to those skilled in the art.

Figure 8A:
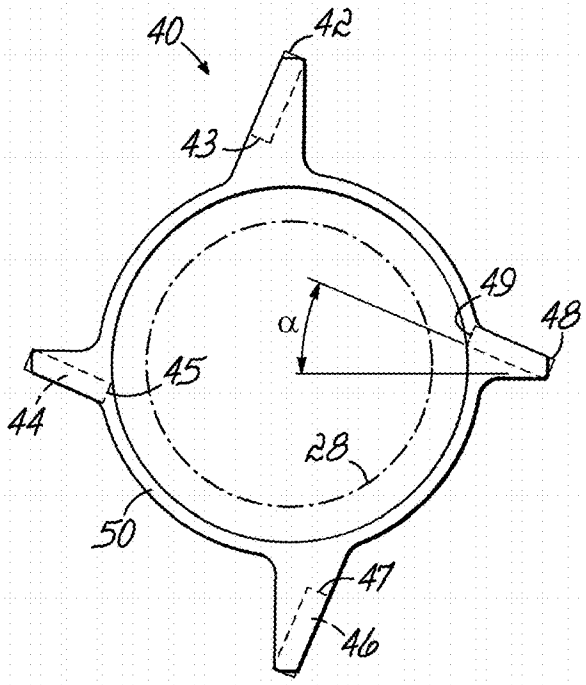
FIG. 8A is an end view of the paddle mixer of FIG. 8.
Figure 8:
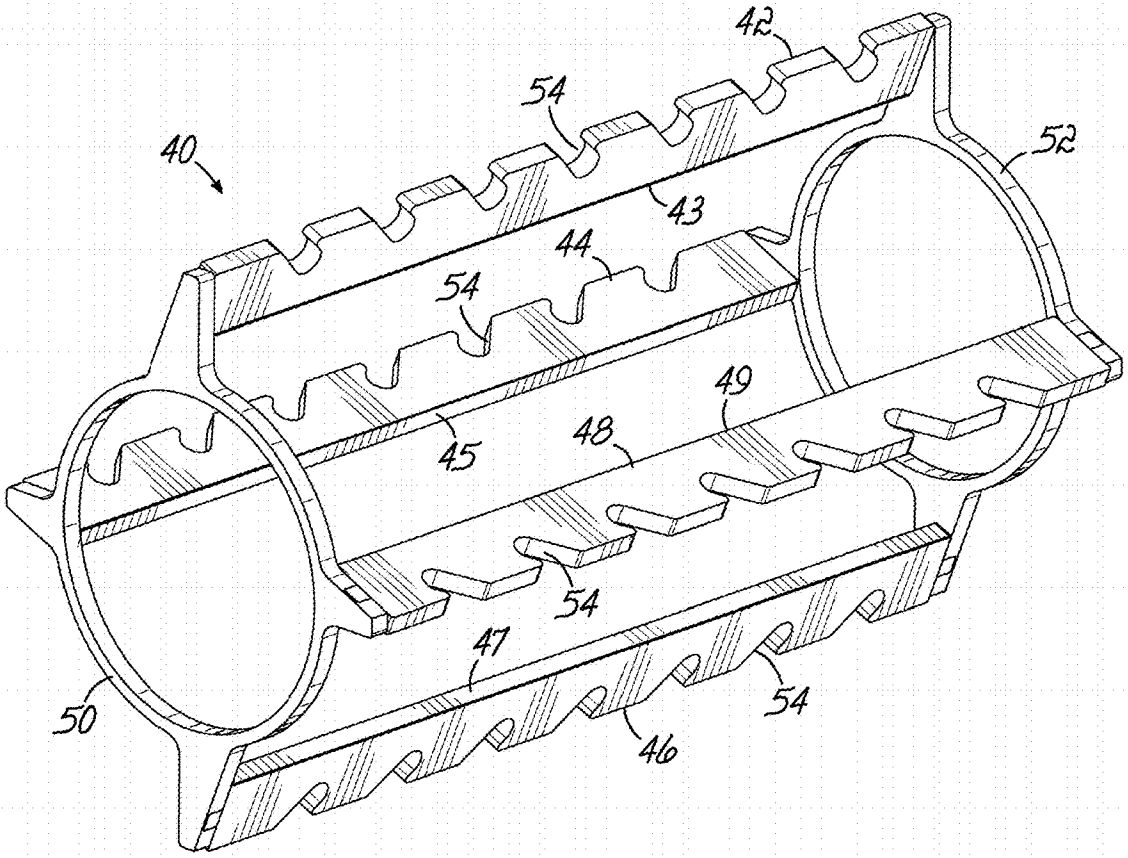
FIG. 8 is perspective view of the paddle mixer of the present invention.
Figure 9:
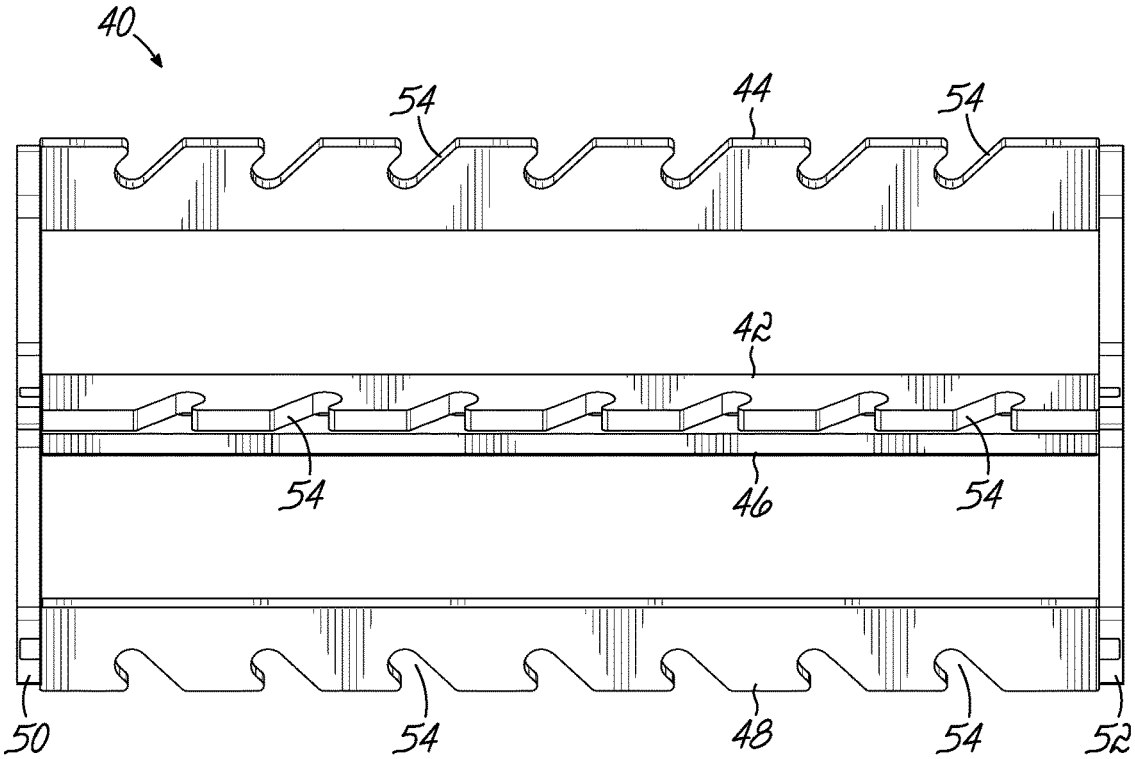
FIG. 9 is a top view of the paddle mixer of FIG. 8.
Figure 10:
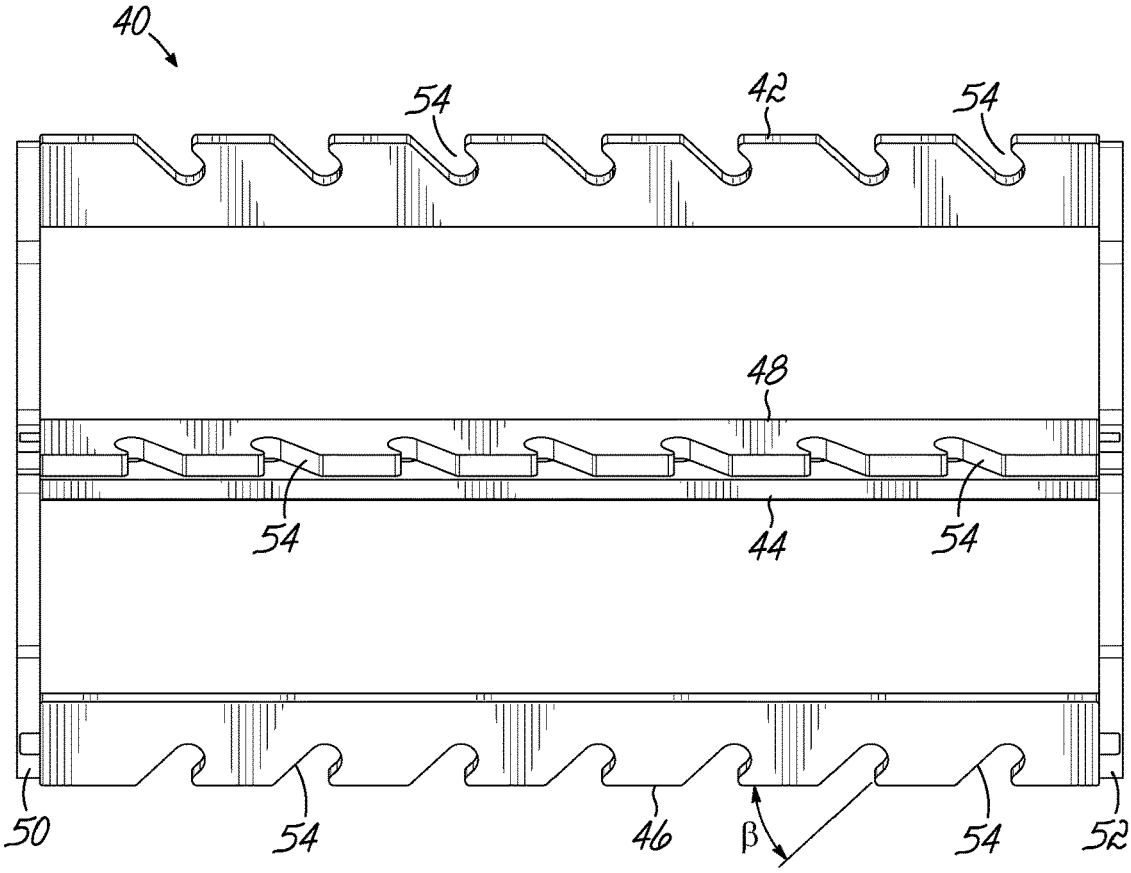
FIG. 10 is a side view of paddle mixer of FIG. 8.
Figure 11:
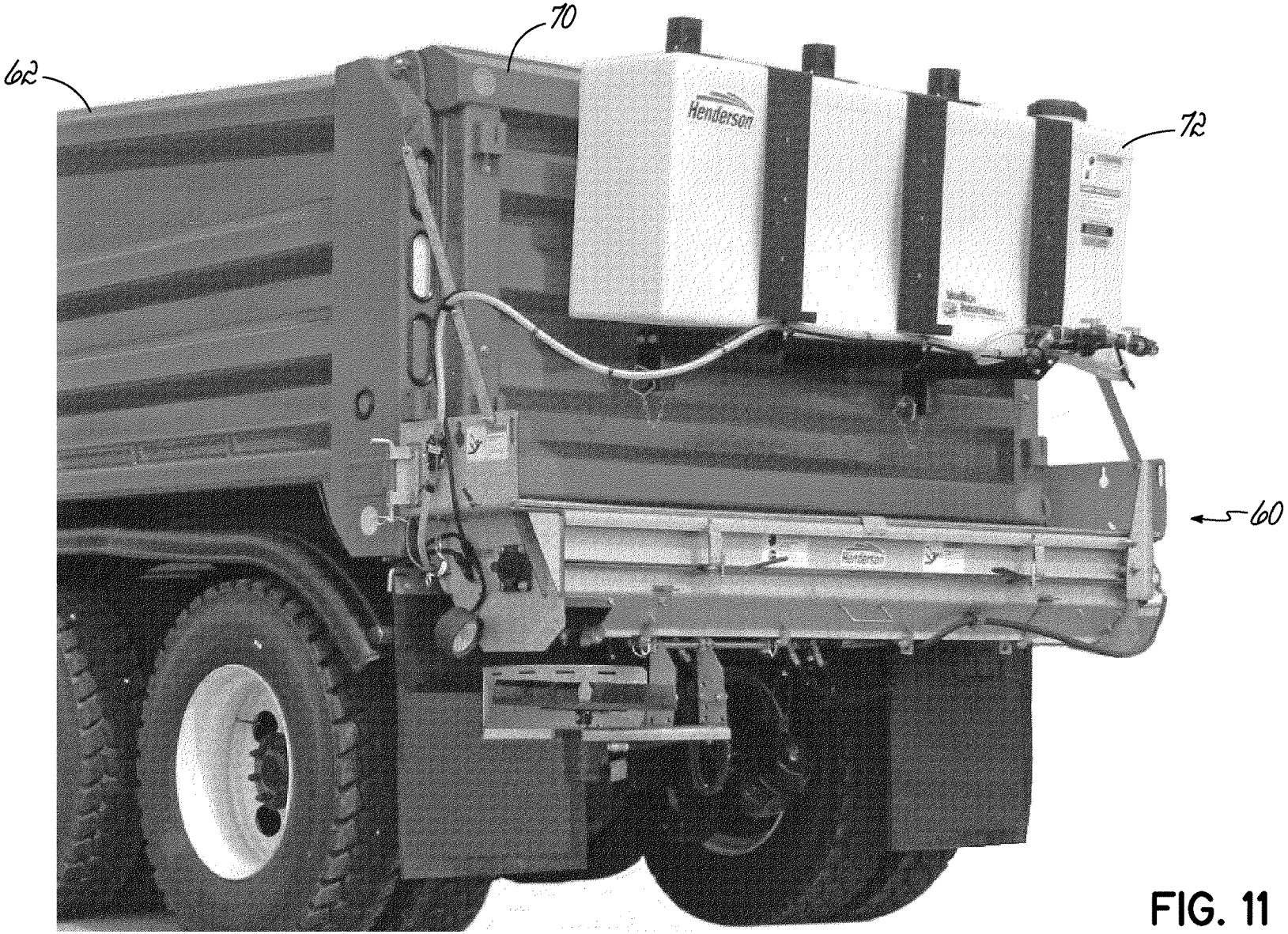
FIG. 11 is a left rear perspective view of another embodiment of spreader of the present invention.
Figure 12:
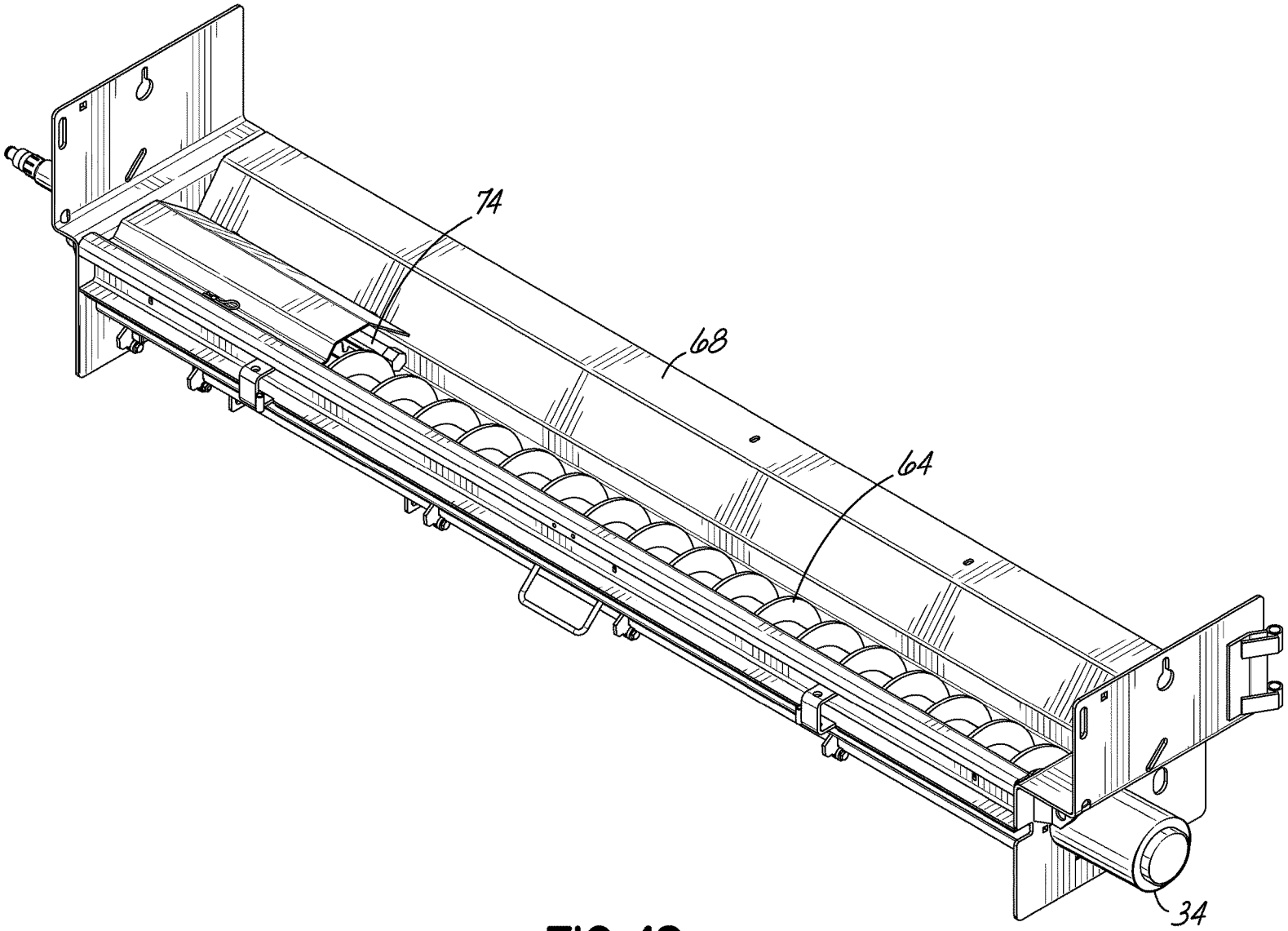
FIG. 12 is a top right rear perspective view of the auger of the spreader of FIG. 11.
Figure 13:
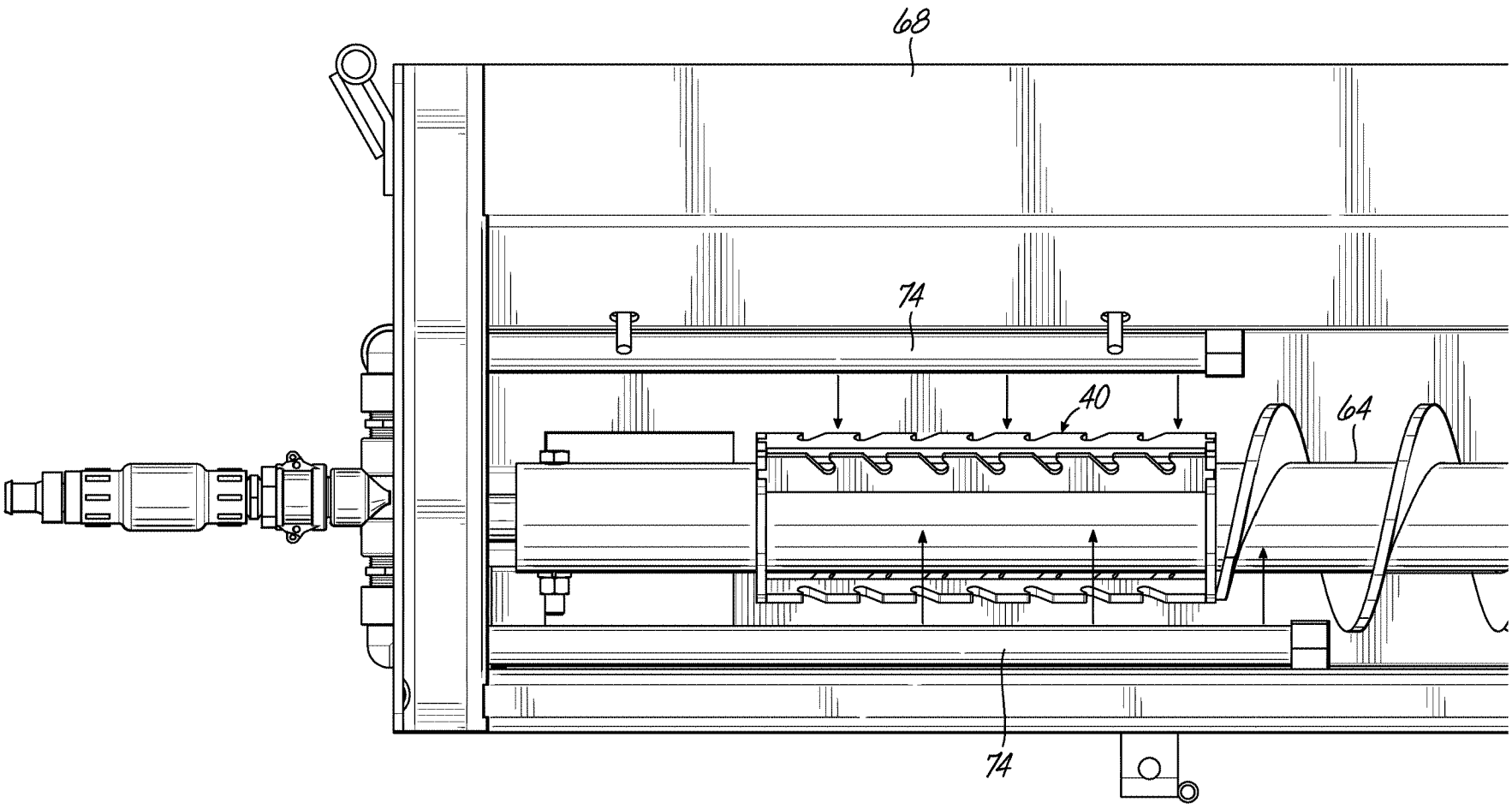
FIG. 13 is an enlarged top view of the left hand portion of the auger of FIG. 12.
Figure 14:
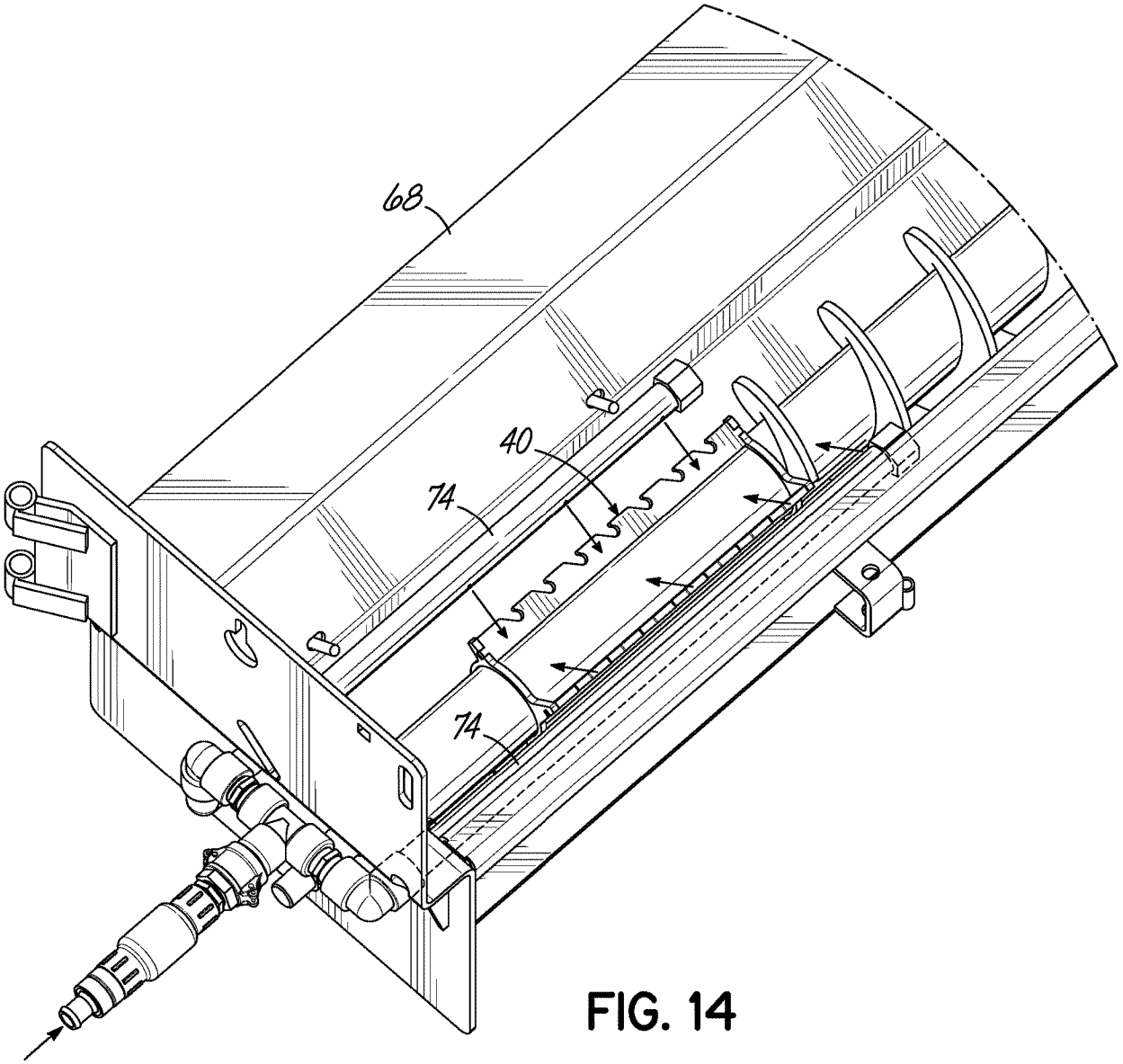
FIG. 14 is a top left rear perspective view of the auger of FIG. 13.

Referring now to FIGS. 8-10, the paddle mixer 40 is shown in more detail. The paddle mixer 40 includes a plurality of blades that are spaced circumferentially around the auger 28. Four example, the paddle mixer 40 can include four blades 42, 44, 46, 48 spaced equally about the circumference of the auger 28. More than four blades or less than four blades could be used in the practice of the present invention, however. As shown in FIG. 8A, the blades extend away from the auger 28 at an angle $\alpha$ of between about 0 degrees and about 90 degrees relative to a cross-sectional center line of the auger 28. Preferably the blades extend away from the auger 28 at an angle $\alpha$ of between about 0 degrees and about 45 degrees relative to a cross-sectional center line of the auger 28. More preferably the blades extend away from the auger 28 at an angle $\alpha$ of about 23 degrees relative to a cross-sectional center line of the auger 28.

The paddle mixer 40 includes first 50 and second 52 spaced apart circular rings. Blades 42, 44, 46, 48 are secured to the rings 50, 52 and the rings 50, 52 are secured to the auger 28. Each blade includes a plurality of notches 54 spaced along a radially outer edge of the blade. As shown in FIG. 10, notches 54 are oriented at an angle $\beta$ of between about 0 degrees and about 90 degrees relative to an axis of rotation of the auger 28. Preferably, the notches 54 are oriented at an angle $\beta$ of about 45 degrees relative to an axis of rotation of the auger 28. Preferably the orientation of the notches 54 in the blades alternates around the circumference of the auger 28. In other words, the notches 54 in a first one of the blades 42 faces one end of auger 28, the notches 54 in a second one of the blades 44 faces the other end of auger 28, the notches 54 in a third one of the blades 46 faces the one end of the auger 28, and the notches 54 in a fourth one of the blades 48 faces the other end of the auger 28. Blades 42, 46 have radially inner edges 43, 47 spaced away from an outer surface of the auger 28, and blades 44, 48 have radially inner edges 45, 49 closely adjacent to the outer surface of the auger 28.

Referring now to FIGS. 11-14, another embodiment of spreader 60 (sometimes referred to as a tailgate spreader) according to the principles of the present invention is illustrated. In this embodiment, the material container of the spreader 60 is a dump body 62 of a dump truck. The auger 64 of this embodiment is oriented generally perpendicular to the longitudinal axis of the vehicle, and the spinner 66 is located off of the longitudinal axis of the vehicle, i.e. at the left hand rear corner of the vehicle. The auger 64 is mounted in a trough 68 which itself is mounted to the end of the bed of the truck adjacent a lower edge of the tailgate 70 of the dump body. As in the prior embodiment, the auger 64 carries a paddle mixer 40 for mixing liquid from liquid container 72 applied by liquid applicators 74 to the material.

Figure 15:
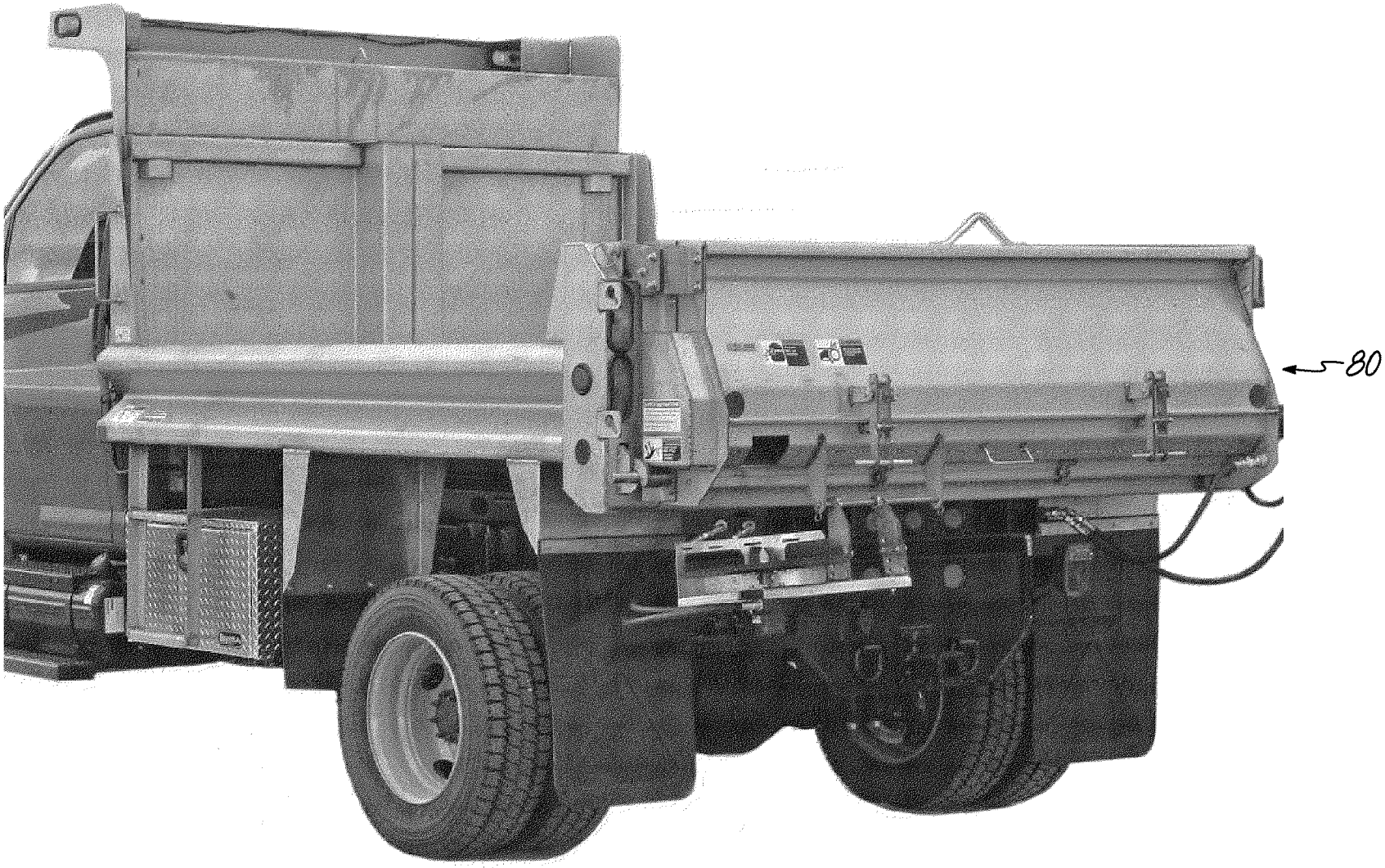
FIG. 15 is a left rear perspective view of yet another embodiment of spreader of the present invention.

Referring now to FIG. 15, yet another embodiment of spreader 80 (sometimes referred to as a replacement tailgate spreader) according to the principles of the present invention is illustrated. This embodiment of spreader 80 is similar to the previously described spreader 60, the main difference being that the auger, auger trough, paddle mixer, and spinner are fabricated as a portion of a replacement tailgate for replacing an OEM tailgate of a dump body.

Figure 16:
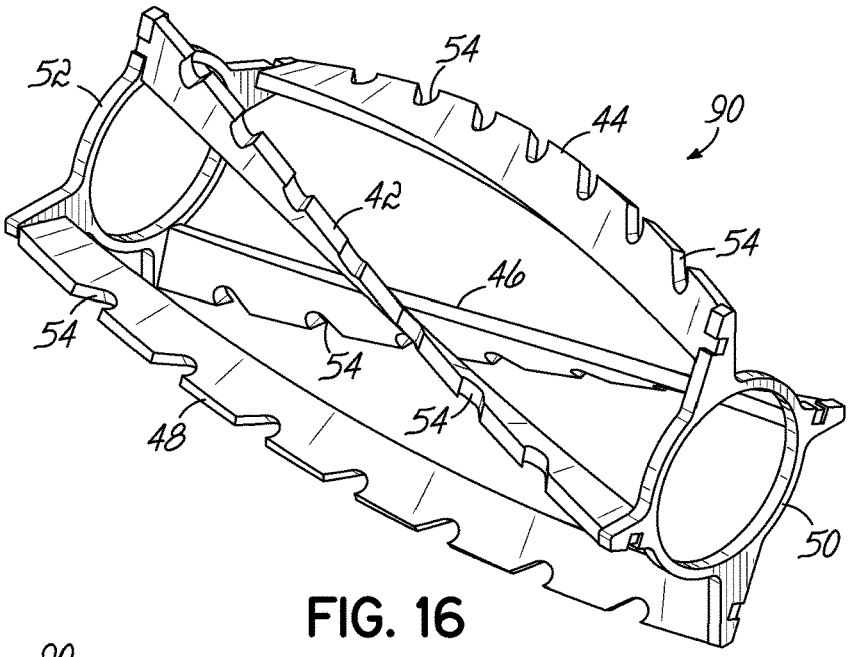
FIG. 16 is perspective view an alternative embodiment of the paddle mixer of the present invention.
Figure 17:
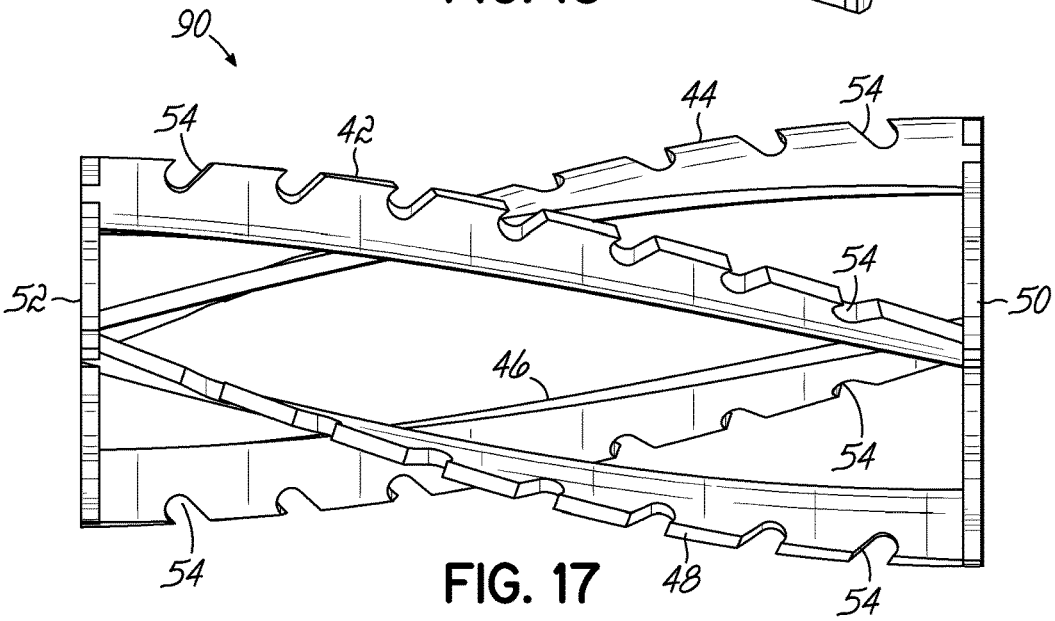
FIG. 17 is a side view of the paddle mixer of FIG. 16.
Figure 18:
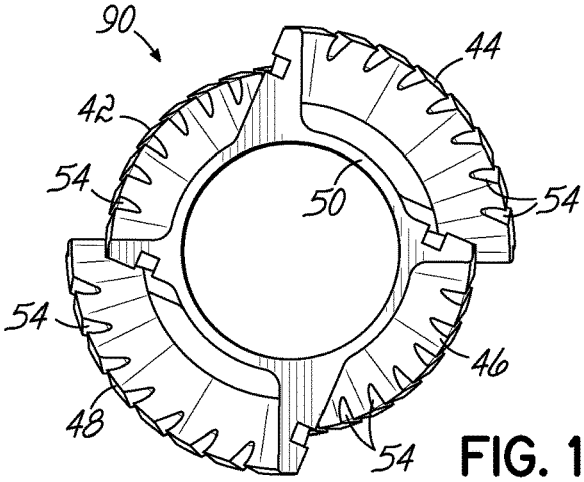
FIG. 18 is an end view of the paddle mixer of FIG. 16.

Referring now to FIGS. 16-18, an alternative embodiment of paddle mixer 90 is illustrated. In these figures, like numbers represent like elements of the previously described paddle mixer 40. The primary difference between the paddle mixer 90 and the paddle mixer 40 is that the spaced apart circular end rings 50 and 52 are twisted relative to one another such that the blades 42, 44, 46, 48 take on a helical geometry along their lengths. In a preferred embodiment, the end rings 50 and 52 are twisted about 90 degrees (i.e. about a quarter turn) relative to each other over the about twelve-inch length of the paddle mixer 90. In other words, in a preferred embodiment, the blades 42, 44, 46, 48 make about one complete turn in about forty-eight inches. The resulting helical geometry of the blades 42, 44, 46, 48 can enhance mixing of the liquid with the material as the liquid is applied to the material with the liquid applicators 30. Of course, pitches other than one turn in forty-eight inches could also be utilized.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A vehicle mounted spreader for spreading materials such as sand, salt, or other granular chemicals onto snow and ice covered paved surfaces comprising:

a hopper adapted to be supported by the vehicle for containing the material to be spread, a liquid container adapted to be supported by the vehicle for containing liquid with which to pre-wet the material, a spinner for spreading the pre-wet material, an auger positioned in said hopper for conveying the material to said spinner, a liquid applicator for applying liquid from the liquid container to the material to pre-wet the material, and a paddle mixer mounted to an end of said auger, at least a portion of said paddle mixer positioned within said hopper, at least a portion of said liquid applicator positioned adjacent said at least a portion of said paddle mixer, said at least a portion of said liquid applicator applying liquid at a position within said hopper to the material adjacent said at least a portion of said paddle mixer, said paddle mixer mixing the liquid and the material, wherein said paddle mixer comprises a plurality of longitudinally extending blades attached to said auger, spaced circumferentially around said auger, and extending away from said auger, wherein said paddle mixer comprises four said blades spaced equally about a circumference of said auger and fixedly secured to said auger, a first pair of said four blades being positioned diametrically opposite to one another and having radially inner edges closely adjacent to an outer surface of said auger, a second pair of said four blades being positioned diametrically opposite to one another and having radially inner edges spaced away from said outer surface of said auger, all said blades positioned along the same length extent of said auger, wherein each said blade includes a plurality of notches spaced along a radially outer edge of said blade, said notches being oriented at an angle of between 0 degrees and 45 degrees relative to an axis of rotation of said auger, and wherein said notches in said first pair of blades face one end of said auger and said notches in said second pair of blades face the other end of said auger.

2. The spreader of claim 1 wherein said hopper is a V-hopper.

3. The spreader of claim 2 wherein said auger is oriented generally parallel to a longitudinal axis of the vehicle, and said spinner is located generally on the longitudinal axis of the vehicle.

4. The spreader of claim 3 including two said augers.

5. The spreader of claim 1 wherein said material container is a dump body of a dump truck.

6. The spreader of claim 5 wherein said auger is oriented generally perpendicular to a longitudinal axis of the vehicle, and said spinner is located off of the longitudinal axis of the vehicle.

7. The spreader of claim 6 wherein said dump body has a tailgate, and wherein said auger is positioned adjacent a lower edge of said tailgate.

8. The spreader of claim 6 wherein said auger is fabricated as a portion of a replacement tailgate for replacing an OEM tailgate of said dump body.

9. The spreader of claim 1 wherein said blades extend away from said auger at an angle of between 0 degrees and 90 degrees relative to a cross-sectional centerline of said auger.

10. The spreader of claim 9 wherein said angle is 23 degrees.

11. The spreader of claim 1 wherein said paddle mixer further comprises first and second circular rings spaced along and secured to said auger, said blades having first ends secured to said first ring and second ends secured to said second ring.

12. The spreader of claim 1 wherein each said blade includes a plurality of notches spaced along a radially outer edge of said blade.

13. The spreader of claim 12 wherein said notches are oriented at angle of between 0 degrees and 90 degrees relative to an axis of rotation of said auger.

14. The spreader of claim 13 wherein said angle is 45 degrees.

15. The spreader of claim 1 wherein each said blade is formed so as to be elongated and extending from a first end of said paddle mixer to a second opposite end of said paddle mixer and straight relative to an axis of rotation of said auger.

16. The spreader of claim 1 wherein each said blade is formed so as to be elongated and extending from a first end of said paddle mixer to a second opposite end of said paddle mixer and helical relative to an axis of rotation of said auger.

17. The spreader of claim 16 wherein each said blade is formed so as to make a quarter turn in twelve inches along a length of said auger relative to the axis of rotation of said auger.

* * * * *